US008693159B2

(12) United States Patent
Jones et al.

(10) Patent No.: US 8,693,159 B2
(45) Date of Patent: Apr. 8, 2014

(54) METHOD AND APPARATUS FOR DIAGNOSTIC COVERAGE OF SAFETY COMPONENTS

(75) Inventors: Derek W. Jones, Galloway (GB); Kevin M. Zomchek, Nashua, NH (US); Richard Galera, Nashua, NH (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 232 days.

(21) Appl. No.: 13/069,588

(22) Filed: Mar. 23, 2011

(65) Prior Publication Data

US 2012/0243139 A1 Sep. 27, 2012

(51) Int. Cl.
*H01H 47/00* (2006.01)
*H01H 47/14* (2006.01)

(52) U.S. Cl.
USPC ..... 361/166; 361/160

(58) Field of Classification Search
USPC ..... 361/166, 160
See application file for complete search history.

(56) References Cited

U.S. PATENT DOCUMENTS

| | | | | |
|---|---|---|---|---|
| 5,023,816 | A * | 6/1991 | Patton et al. | 700/286 |
| 7,793,774 | B2 * | 9/2010 | Cole et al. | 198/810.01 |
| 2006/0209488 | A1 * | 9/2006 | Papenbreer | 361/160 |

* cited by examiner

*Primary Examiner* — Jared Fureman
*Assistant Examiner* — Lucy Thomas
(74) *Attorney, Agent, or Firm* — Boyle Fredrickson, S.C.

(57) ABSTRACT

A method and system for diagnostic coverage of safety components monitors the state of a safety chain and each of the safety devices in the chain. A fault condition is detected if one of the safety devices indicates that the safety chain should be open but the safety chain indicates that it is closed. In order to prevent an inadvertent reset of the fault condition by opening the safety chain via a second safety device, the fault condition is latched until the monitoring system verifies that the faulty safety device has been corrected.

11 Claims, 4 Drawing Sheets

FIG. 4
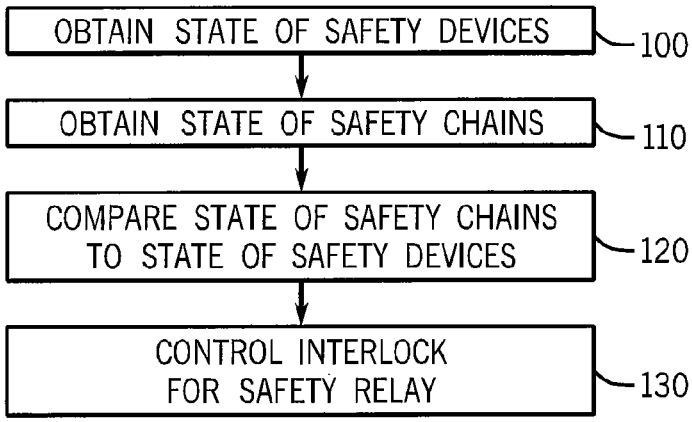
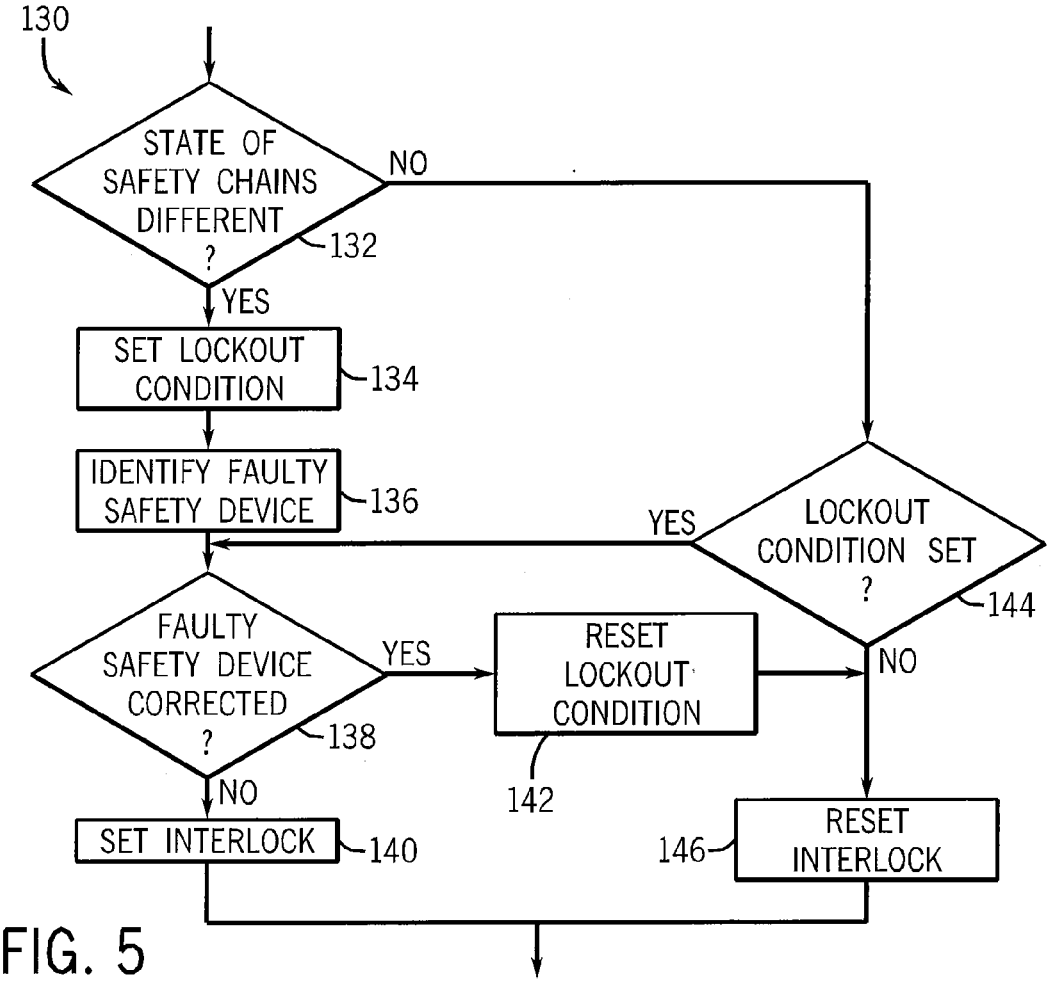
FIG. 5

METHOD AND APPARATUS FOR DIAGNOSTIC COVERAGE OF SAFETY COMPONENTS

BACKGROUND OF THE INVENTION

The subject matter disclosed herein relates to a safety system for use in controlling an industrial device. More specifically, a controller monitors a safety relay and accompanying safety devices to provide improved diagnostic coverage of the safety system.

Industrial machines often include rotating or moving mechanical components controlled by an industrial controller. The machine may periodically require intervention by a human operator, for example, to load or inspect a part or assembly being manufactured. Intervention by the operator within an area in which the machine is being controlled creates a potential for injury to that operator. Consequently, safety devices, including but not limited to light curtains, safety mats, or emergency stop buttons, are often incorporated into the system to reduce the risk of injury. If, for example, an operator breaks a light curtain, steps on a safety mat, or presses the emergency stop button, a signal is sent to the controller to prevent operation while the operator is interacting with the machine. When the operator exits the area protected by a light curtain or safety mat or resets the emergency stop button, the signal is reset, allowing the machine to resume operation.

However, the potential exists that the safety device may experience a failure. Further, the safety device may fail in a manner that improperly indicates it is safe for the operator to interact with the machine. Such a failure may result in an increased risk of injury to an operator who is expecting the safety device to prevent operation of the machine or process and who may not exercise the same caution during the interaction with the machine that may be exercised had no safety device been present.

Consequently, it is desirable to include redundancy in safety devices to avoid the potential of a single failure from causing improper operation or failure of the safety system. Many safety devices include two or more sets of contacts which are opened or closed in tandem responsive to activation of the safety device. The multiple sets of contacts are then wired in parallel and, if either set of contacts indicates an operator is interacting with the machine, operation of the machine is prohibited.

It is also known in the art to utilize a safety relay in cooperation with the redundant contacts to enable or disable operation of a power device, including, but not limited to, contactors, starters, and drives. The safety relay includes inputs to receive signals from the contacts of the safety device. The safety relay then transmits a command signal from the industrial controller to the power device if the signals from the safety devices are in the correct state, either opened or closed, according to the application requirements. In addition, the safety relay may compare the state of the redundant contacts and enter a lockout condition if the redundant contacts are in different states, indicating that one of the contacts has failed. If, for example, the contacts of the safety device are normally closed, the safety relay maintains the lockout condition until both inputs to the safety relay, corresponding to the state of the contacts, are opened and subsequently closed.

As industrial systems increase in complexity and size, the system may require multiple safety devices, such as a light curtain and a safety mat or multiple emergency stop buttons located around the system. Providing separate safety relays to monitor the operation of each safety device may undesirably increase the cost of the safety system. Consequently, multiple safety device s are often wired in series, resulting in a safety chain, providing a set of signals as a single input to the safety relay. The safety chain, as used herein, refers to multiple safety devices connected in series to provide a set of signals corresponding to the state of the contacts of the series-connected safety devices. The resulting set of signals generated by the series-connected safety devices to the safety relay will indicate if any one of the safety devices requires the safety relay to remove the control signal to the power device.

However, connecting multiple safety devices in series is not without its drawbacks. A failed safety device may be masked or ignored by resetting the safety relay with another of the safety devices. For example, if one safety device is triggered and one set of the redundant contacts has failed, remaining closed, the operational set of contacts will still open, stopping the power device. The safety relay will detect the difference in state of the two contacts and enter into the lockout condition. An operator will first notice the lockout condition when the safety device that triggered the stop is reset. The safety relay, being in a lockout condition, will not pass the command signal to the power device, preventing it from restarting. If the original safety device is again triggered, the safety signals will again be in different states as a result of the failed contacts and will remain so until the safety device is repaired or replaced. However, if another safety device, connected in series with the original safety device is triggered, both safety signals will open, resetting the lockout condition. After resetting the second safety device, the lockout condition will have been removed and the power device will be able to resume operation without repairing and/or replacing the defective safety device. The power device will be operating at a reduced safety level because a single additional failure of the second set of contacts of the failed safety device will render the faulty safety device incapable of stopping the power device.

Thus, it would be desirable to provide additional diagnostic monitoring of the safety system with minimal additional cost to prevent a second, operational safety device from clearing a lockout condition caused by a first, faulty safety device.

BRIEF DESCRIPTION OF THE INVENTION

A method and system for diagnostic coverage of safety components monitors the state of a safety chain and each of the safety devices in the safety chain. A fault condition is detected if the state of one of the safety devices does not correspond to the state of the safety chain. In order to prevent an inadvertent reset of the fault condition by opening the safety chain via a second safety device, the fault condition is latched until the monitoring system verifies that the faulty safety device has been corrected.

According to one embodiment of the invention, a safety system for use in controlling an industrial device includes a plurality of safety switches. Each safety switch includes at least two contacts, and each of the contacts of one of the safety switch is activated in tandem responsive to a single trigger. The safety system also includes a safety relay selectively providing a control signal to the industrial device as a function of a command signal and a safety signal. The safety relay has a plurality of inputs and a plurality of outputs. A first input of the safety relay is connected in series to a first contact of each of the safety switches. The safety switches are, in turn connected in series to a control voltage. The series connection from the control voltage through each safety switch provides the safety signal to the safety relay. A second input of the safety relay is connected to the command signal for the industrial device. A first output of the safety relay provides the control signal to the industrial device, and a second output of the safety relay is configured to indicate the state of the safety signal. The safety system further includes a controller having a plurality of inputs, at least one output, and a processor configured to execute a stored program. The processor executes the stored program to identify a fault condition if one of the safety switches has a contact which is not activated in tandem with the other contacts of the safety switch and to provide an interlock to the safety relay to prevent another of the safety switches from resetting the fault condition.

According to another embodiment of the invention, a method of increasing the diagnostic coverage of a safety system having a plurality of safety devices, wherein each safety device includes at least three contacts activated in response to a single trigger, and a safety relay used to control an industrial device is disclosed. A first contact of each safety device is connected in series to provide a first signal corresponding to a state of a first safety chain to a first input of the safety relay. A second contact of each safety device is connected in series to provide a second signal corresponding to a state of a second safety chain to a second input of the safety relay. The state of the first and the second safety chains is communicated from the safety relay to a controller. A third contact of each safety device is connected to one of a plurality of inputs of the controller. If the state of the first and the second safety chains are different, a lockout condition is generated, the state of each input to the controller from the safety devices is read to determine which safety device caused the lockout condition, and a relay from an output of the controller is controlled. The relay is connected in series with a command signal for the industrial device to disconnect the command signal from the industrial device when the lockout condition is generated. However, if the state of the first and the second safety chains are the same and if no lockout condition exists, the relay from the output of the controller is controlled to connect the command signal to the industrial device, but if the lockout condition exists, the controller monitors the inputs and clears the lockout condition when the identified safety device is no longer causing the lockout condition.

According to still another embodiment of the invention, a safety system diagnostic monitor includes a controller having a plurality of inputs and at least one output. A first portion of the inputs are configured to receive an input signal from one of a plurality of contacts associated with a safety switch, on which each of the contacts is activated in tandem in response to a single trigger. A second portion of the inputs are configured to receive at least one input signal from a safety relay. The input signals from the safety relay correspond to a status of a safety chain input to the safety relay. The output of the controller is configured to reset an interlock signal if each of the input signals from the safety switches correspond to the input signals which indicate the status of the safety chains input to the safety relay, and the output of the controller is configured to set the interlock signal if at least one of the input signals from the safety switches does not correspond to the input signals which indicate the status of the safety chains input to the safety relay.

Thus, it is a feature of the present invention, that a controller may be used to monitor the safety system and provide an interlock when one of the safety chains indicate a fault condition. By preventing and inadvertent reset of the fault condition by opening a secondary safety device, the reliability and safety rating of the safety system is improved. Preferably, an existing controller, such as a controller used to control the process being monitored by the safety system, may be used to monitor the safety system.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Various exemplary embodiments of the subject matter disclosed herein are illustrated in the accompanying drawings in which like reference numerals represent like parts throughout, and in which:

FIG. 4 is a flowchart illustrating the steps executed by a processor according to one embodiment of the present invention; and FIG. 5 is a flowchart illustrating additional steps for controlling the interlock from FIG. 4.

Figure 1:
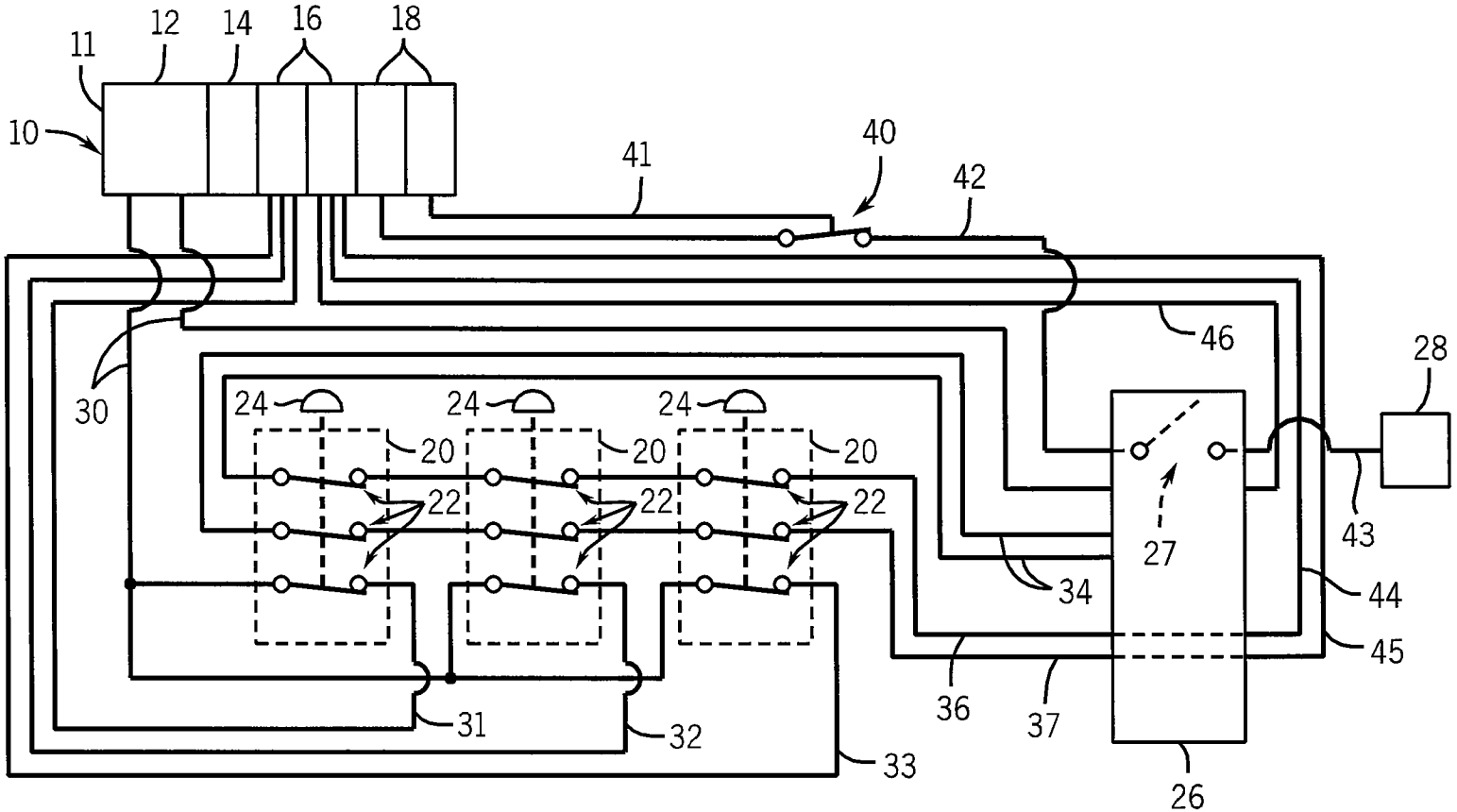
FIG. 1 is a schematic representation of one embodiment of the present invention.

In describing the various embodiments of the invention which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION OF THE PREFERRED EMBODIMENTS

Figure 2:
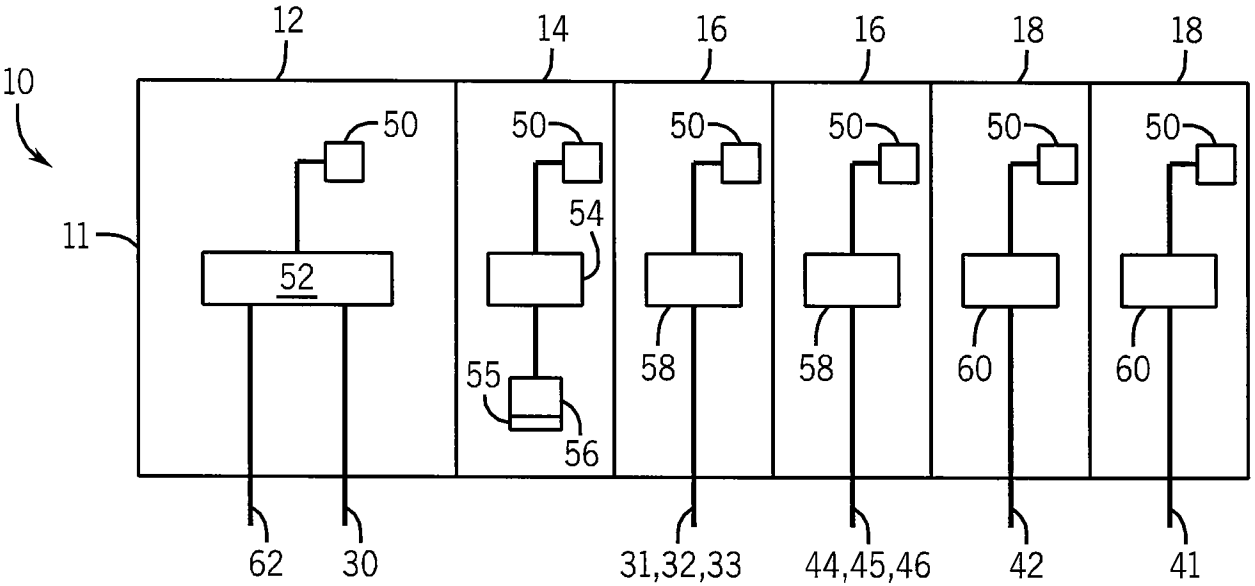
FIG. 2 is a block diagram representation of the controller from FIG. 1.

Turning initially to FIG. 1, an industrial controller 10 for monitoring safety devices 20 is provided to improve diagnostic coverage of the safety system. The industrial controller 10 includes a power supply 12, controller module 14, input modules 16, and output modules 18. Each of the controller module 14, input modules 16, and output modules 18, receive power from the power supply 12 via a backplane connection 50, as shown in FIG. 2. It is contemplated that the industrial controller 10 may be provided in many other configurations as is known to one skilled in the art. For example, a single input module 16 and a single output module 18 may be used. Optionally, remote input/output racks may be used. According to still another embodiment, the power supply 12, controller module 14, input module 16, and output modules 18 may be integrated into a single device. Still other arrangements and configurations of local and remote modules may be used without deviating from the scope of the invention. Further, the industrial controller 10 may be provided as a separate controller or be incorporated as a portion of the controller used to control the machine or process which the safety system is monitoring.

Referring also to FIG. 2, the power supply 12 receives input power 62, which may be, for example, 110 V AC, and includes electronic circuitry 52 to convert the input power 62 to one or more suitable control voltages 30, according to the system requirements. Additionally, the control voltage is supplied to other modules in the rack 11 via a backplane connection 50. The processor module 14 includes a processor 54, memory 56, and a series of instructions 55 which are stored in the memory 56 and executable on the processor 54. In addition to receiving power over the backplane connection 50, the processor module 14 is also configured to send and receive data signals over the backplane connection 50. The backplane connection 50 is connected to the processor 54. The processor 54 receives input signals from input modules 16 via the backplane connection 50, executes the instructions 55 to control a machine or process according to the input signals, and generates output signals which are communicated to the output modules 18 via the backplane connection 50. Each input module 16 receives input signals from devices in the controlled system, processes the input signals with an electronic circuit 58, and communicates the input signals to other modules as required by the system requirements via the backplane connection 50. Each output module 18 receives signals from other modules as required by the system requirements via the backplane connection 50, processes the output signals with an electronic circuit 60, and sends the output signals to devices in the controlled system.

Figure 3:
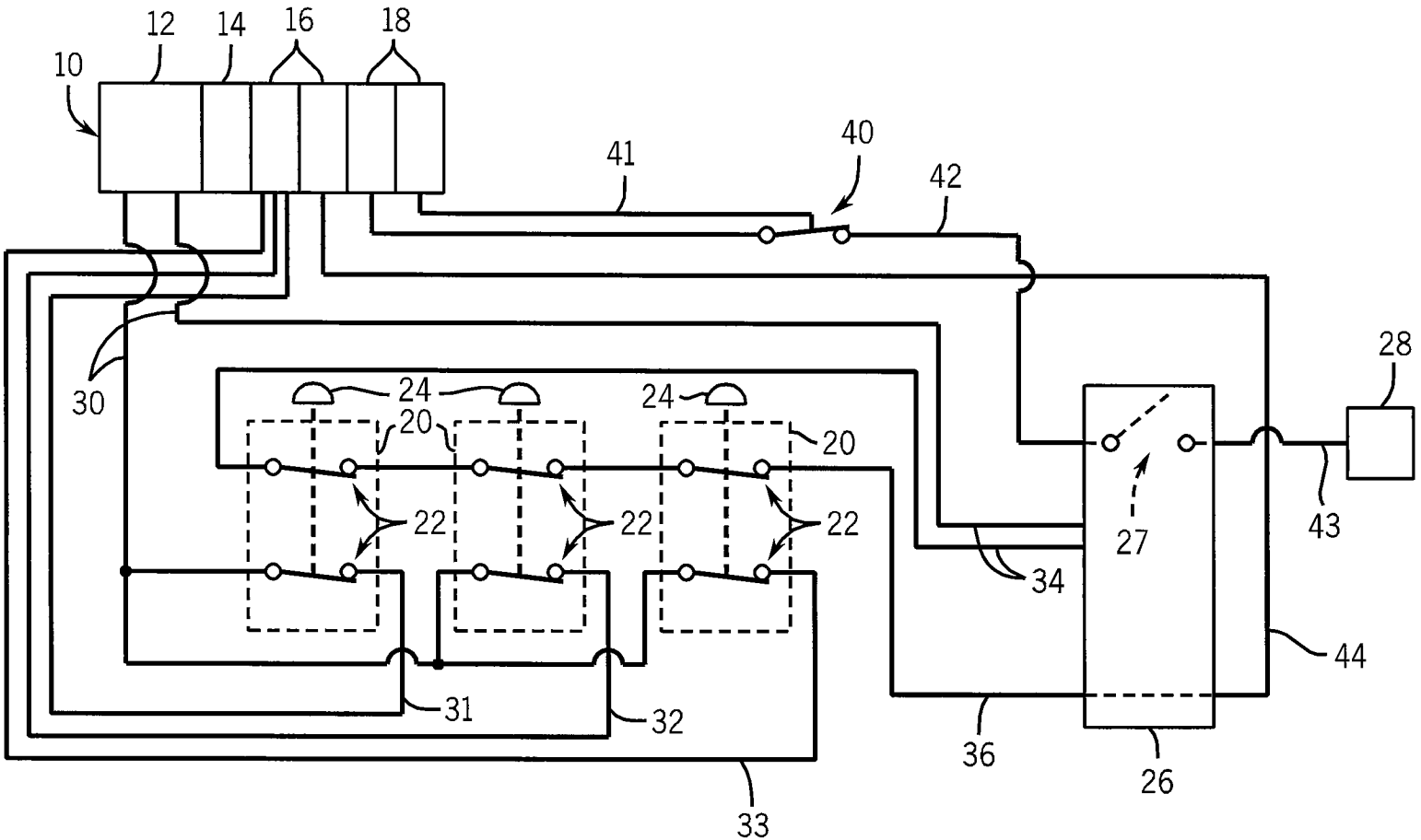
FIG. 3 is a schematic representation of another embodiment of the present invention.

Referring again to FIG. 1, the safety system includes three safety devices 20 connected in series. Each safety device 20 includes multiple contacts 22, and each contact of the safety device 20 is opened or closed by a single trigger, for example, an emergency stop button 24. Other triggers, including but not limited to light curtains, safety mats, gate switches, or proximity sensors, may be used to control the contacts 22 of the safety device 20. Preferably, the trigger, such as the emergency stop button 24, and the contacts 22 are provided as a single device. As illustrated in FIG. 1, each safety device 20 includes three contacts 22 operating in tandem. According to another embodiment of the invention, as illustrated in FIG. 3, each safety device 20 may include two contacts 22 operating in tandem. Optionally, the safety device 20 may also include more than three contacts 22 operating in tandem from a single trigger. It is further contemplated that the number of safety devices 20 connected in series may be two or more and that various triggers, as required by the system, may be used to activate each safety device 20.

The safety system further includes a safety relay 26 which selectively provides a command signal 42 to an industrial device 28. The industrial device 28 may be, for example, a power device, which controls the transmission of power or converts power from one state to another, including but not limited to a contactor, a motor starter, or a motor drive. The command signal 42 is output from a controller, which may be the monitoring controller 10 or, optionally, may be a separate controller, and provided as an input to the safety relay 26. The safety relay 26 also receives a control voltage 30 from the power supply 12. Optionally, the safety relay 26 may receive a control voltage 30 from any suitable source available in the system. A contact 27 internal to the safety relay 26 selectively provides a control signal 43 to the industrial device 28 as a function of the command signal 42 and at least one safety signal, 36 or 37.

Each safety signal, 36 or 37, is generated by connecting the safety devices 20 in series, sometimes referred to as a safety chain. Preferably, each of the contacts 22 in the safety devices are normally closed. A voltage 34, typically corresponding to the control voltage 30, is output from the safety relay 26, conducted through a first of the normally closed contacts 22 in each safety device 20, and returned to the safety relay 26 as a safety signal, 36 or 37, input. If each safety device 20 includes at least three contacts 22, a first safety signal 36 may be generated by connecting a first set of contacts 22 from each safety device 20 in series and a second safety signal 37 may be generated by connecting a second set of contacts 22 from each safety device 20 in series. Each of the safety signals, 36 and 37, are provided as inputs to the safety relay 26. The state of each safety signal, 36 or 37, is provided as an output, 44 or 45 respectively, from the safety relay 26 and connected to an input of the controller 10.

The controller 10 additionally monitors the state of each safety device 20. A control voltage 30 is provided from the power supply 12 to an input side of one of the contacts 22 in each safety device 20. Optionally, the control voltage 30 may be provided from any suitable source, for example, a terminal on an input module 16 may provide the control voltage 30 which is, in turn, supplied to the input modules 16 from the power supply 12 via the backplane connections 50. The output side of each contact 22 is connected to a terminal on an input module 16 of the controller 10. Thus, a signal, 31, 32, or 33, indicating the state of each safety device 20 is returned to the controller 10.

The safety system also includes an interlock to prevent resetting of a fault condition when the fault condition is still present. According to one embodiment of the invention, a relay 40 maybe provided in series with the command signal 42 input to the safety relay 26. Optionally, the relay 40 may be provided in series with the control signal 43 output from the safety relay 26. It is contemplated that still other configurations for providing the interlock may be used without deviating from the scope of the invention. The processor 54 is configured to monitor each of the input signals, 31, 32 and 33, representing the state of each safety device 20; to monitor each of the input signals, 44 and 45, representing the state of each safety signal, 36 and 37; and, as a function of each of the input signals, to control an output signal 41 used to open or close the relay 40.

In operation, the safety relay 26, controls operation of the industrial device 28 as a function of the command signal 42 from the controller and of the safety signal inputs, 36 or 37, received at the safety relay 26. Referring next to FIG. 4, at step 100 the controller 10 monitors the operation of each safety device 20 to verify that each contact 22 is opening or closing in tandem in response to its trigger, such as the emergency stop button 24. If, for example, the contacts 22 are normally closed, the presence of a voltage 34 at the safety signal input, 36 or 37, of the safety relay 26 indicates that the safety chain is closed and the system may operate normally. During normal operation, the safety relay 26 closes the internal contact 27, passing the command signal 42 input from a controller to the control signal 43 output from the safety relay 26 and to the industrial device 28.

If the need arises or if the operator wishes to stop the industrial device 28, the operator presses the emergency stop button 24, changing the state of each contact 22, for example, opening each contact 22. As a result, each safety signal, 36 or 37, and the input signal, 31, 32, or 33, corresponding to the state of the triggered safety device 20, turns off. The safety relay 26 opens the internal contact 27, preventing the command signal 42 from communicating to the industrial device 28. If no lockout condition has occurred, the safety relay 26 keeps the internal contact 27 open until each of the safety signals, 36 or 37, are again on, indicating that the industrial device 28 may again be operated. Once the safety signals, 36 or 37, again indicate that it is safe to control the industrial device 28, the safety relay 26 closes the internal contact 27 and passes the command signal 42 input to the control signal 43 and on to the industrial device 28.

Referring next to FIG. 4, at step 100, the controller 10 monitors the operation of each safety device 20 to verify that each contact 22 is opening or closing in tandem in response to its trigger, such as the emergency stop button 24. As shown in step 110, the controller also 10 monitors the state of the safety chains, 36 or 37. The state of the safety chains are provided to the controller 10 by a pair of outputs, 44 and 45, from the safety relay 26, which correspond to the state of each safety signal, 36 or 37. At step 120, the controller compares the state of each safety device 20 to the state of the safety chains, 44 and 45. The controller 10 may determine the presence of a lockout condition if the state of the two signals, 44 and 45, are not the same. Optionally, the safety relay 26 may provide an output signal 46 corresponding to the presence of a lockout condition. At step 130 and referring also to FIGS. 1 and 5, the controller 10 provides an output signal 41 to control an interlock device, such as a relay 40, to inhibit the command signal 42 from being sent to the safety relay 26 if a fault has occurred in the safety system.

A fault condition occurs if the controller 10 detects that one of the contacts 22 within a safety device 20 failed to operate in tandem with the other contacts 22 in the same safety device 20. In a safety device 20 having only two contacts 22 operating in tandem, see FIG. 3, this fault condition may result from either the safety signal 36 or the input, 31, 32, or 33, indicating the state of the safety device 20 remaining on when the emergency stop button 24 has been pressed. The controller 10 receives the input signal 44 indicating the state of the safety signal 36 and compares it to the state of each safety device 20. If the state of the safety signal 36 does not correspond to the state of each safety device 20, a fault condition occurs. If the safety device 20 has three or more contacts 22 operating in tandem, see FIG. 1, the fault condition may similarly result if either of the input signals, 44 or 45, indicate that the state of one of the safety signals, 36 or 37, does not correspond to the state of each safety device 20. This fault condition will typically also result in a lockout condition being generated.

Referring again to FIG. 5 and as seen in step 132, the processor 54 executing in the controller 10 may compare the state of the two input signals, 44 and 45, representing the safety chains, 36 and 37. If the state of these two input signals, 44 and 45, are different, the controller generates a lockout condition, as shown in step 134. Optionally, the lockout condition may be detected by the safety relay 26 performing a comparison of the two safety signals, 36 and 37, and providing a corresponding lockout signal 46 to an input module 16 of the controller 10. At step 136, the processor 54 reads the input signals, 31, 32, or 33, corresponding to the state of each safety device 20 to determine which safety device 20 has been activated. At step 138, the processor 54 continues to monitor the safety device 20 that had been activated to determine whether the fault condition has been corrected. If not, the interlock signal 41 is set, as shown at step 140, indicating that a problem exists with the safety system.

The industrial control program repeatedly executes at periodic intervals to perform the steps identified in FIG. 4. Step 130 is, therefore, periodically executed, to control the interlock signal 41. The state of the safety chains are monitored and if they remain in different states, steps 134-140, outlined above are repeated. If however, the state of the safety chains, 36 and 37, are again the same, either the safety device 20 that was previously triggered has been reset or repaired. As a result, if the state of the safety chains, 36 and 37, are again the same, the controller 10 determines whether the lockout condition had previously been set, as shown in step 144. If not, the interlock signal 41 is maintained in the reset state lockout such that the command signal 42 may be passed to the safety relay 26. If a lockout condition did exist, the controller monitors whether the previously-identified, faulty safety device has been corrected. If so, the lockout condition and interlock may be reset, per steps 142 and 146, otherwise, the interlock condition is maintained per step 140.

Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention

We claim:

1. A safety system for use in controlling an industrial device, comprising:

a plurality of safety switches, each safety switch including at least two contacts wherein the contacts of each safety switch are activated in tandem responsive to a single trigger and wherein a first contact of each of the safety switches is connected in series with a control voltage to define a first safety signal;

a safety relay having a plurality of inputs and a plurality of outputs, wherein a first input of the safety relay is configured to receive the first safety signal, wherein the first safety signal is in a first state when the first contact of each of the safety switches is closed and wherein the safety signal is in a second state when the first contact of at least one of the safety switches is open, a second input of the safety relay is configured to receive a second safety signal, wherein the second safety signal is in a first state when a second contact of each of the safety switches is closed and wherein the safety signal is in a second state when the second contact of at least one of the safety switches is open, a third input of the safety relay is connected to a command signal for the industrial device, a first output of the safety relay is configured to generate a first signal corresponding to the state of the first safety signal, and a second output of the safety relay is configured to generate a second signal corresponding to the state of the second safety signal; and a controller having:

a first input configured to receive the first signal corresponding to the state of the first safety;

a second input configured to receive the second signal corresponding to the state of the second safety signal;

a plurality of additional inputs wherein each additional input corresponds to one of the plurality of safety switches and is configured to receive an input signal from one of the contacts of the corresponding safety switch;

a processor configured to:

generate an interlock when the first and second inputs indicate the state of the first safety seal is different than the state of the second safety signal, identify which of the plurality of safety switches triggered the interlock, and reset the interlock when the identified safety switch is triggered and the first and the second inputs indicate the state of the first safety signal is the same as the state of the second safety signal; and an output configured to generate a signal corresponding to the interlock; and a switch connected in series with the command signal for the industrial device, wherein the switch is selectively opened and closed as a function of the signal corresponding to the interlock from the output of the controller.

2. The safety system of claim 1 wherein the switch is a relay controlled by the output of the controller.

3. The safety system of claim 1 wherein each safety switch includes at least three contacts and the third contact of each of the safety switches is connected to the additional input of the controller corresponding to that safety switch.

4. The safety system of claim 1 wherein a third output of the safety relay is configured to indicate a lockout condition when each of the first and the second safety signals are in different states and to indicate an absence of the lockout condition when each of the first and the second safety signals are in the same state.

5. The safety system of claim 4 wherein the third output from the safety relay is connected to one of the inputs of the controller and the processor generates the interlock responsive to the signal from the third output of the safety relay.

6. The safety system of claim 2 wherein the relay is connected in series with the control signal either before the third input of the safety relay or at an output of safety relay connected to the industrial device.

7. A method of increasing the diagnostic coverage of a safety system having a plurality of safety devices, wherein each safety device includes at least two contacts activated in tandem responsive to a single trigger, and a safety relay used to control an industrial device, comprising the steps of:

generating a first safety signal having a first state and a second state, wherein the first safety signal is in the first state when a first contact of each safety device is one of opened and closed and wherein the first safety signal is in the second state when the first contact of at least one of the safety devices is opened and the first contact of at least one other of the safety devices is closed;

generating a second safety signal having a first state and a second state, wherein the second safety signal is in the first state when a second contact of each safety device is one of opened and closed and wherein the second safety signal is in the second state when the second contact of at least one of the safety devices is opened and the second contact of at least one other of the safety devices is closed;

receiving, the first safety signal and the second safety signal at the safety relay;

communicating the state of the first and the second safety signals from the safety relay to a controller;

receiving a plurality of input signals at the controller, wherein each input signal corresponds to one of the plurality of safety devices and wherein the input signal is from one of the contacts of the corresponding safety device;

generating a lockout condition with the controller when the state of the first safety signal is different from the state of the second safety signal;

reading the state of each of the plurality of input signals to the controller from the safety devices to determine which safety device caused the lockout condition;

resetting the lockout condition when the safety device that caused the lockout condition is triggered and the state of the first safety signal is the same as the state of the second safety signal; and controlling a relay from an output of the controller, the relay connected in series with a command signal for the industrial device, to disconnect the command signal from the industrial device.

8. The method of claim 7 further comprising the steps of executing a delay timer if the state of the first and the second safety chains are different and generating the lockout condition upon expiration of the delay timer.

9. The method of claim 7 wherein the step of generating the lockout condition further comprises:

comparing the state of the first safety chain to the state of the second safety chain, wherein the comparing is performed with an electronic circuit in the safety relay; and generating an output from the safety relay to the controller indicative of the lockout condition if the state of the first safety chain is different from the state of the second safety chain.

10. The method of claim 7 wherein the step of generating the lockout condition further comprises:

comparing the state of the first safety chain to the state of the second safety chain, wherein the comparing, is performed with the controller; and setting an internal signal within the controller indicating the presence of a lockout condition if the state of the first safety chain is different from the state of the second safety chain.

11. A safety system diagnostic monitor for monitoring the status of a plurality of safety switches operatively connected to a safety relay, each safety switch having a plurality of contacts activated in tandem responsive to a single trigger, the safety system comprising:

a controller having a plurality of inputs and at least one output, wherein a first portion of the plurality of inputs are configured to receive an input signal from a first contact selected from the plurality of contacts associated with the safety switch, a second portion of the plurality of inputs are configured to receive a first safety signal input from the safety relay and a second safety signal input from the safety relay, wherein the first safety signal input is in a first state when a first contact of each safety switch is one of opened and closed and wherein the first safety signal input is in a second state when the first contact of at least one of the safety switches is opened and the first contact of at least one other of the safety switches is closed and wherein the second safety signal input is in a first state when a second contact of each safety switch is one of opened and closed and wherein the second safety signal input is in a second state when the second contact of at least one of the safety switches is opened and the second contact of at least one other of the safety switches is closed, the controller identifies which of the plurality of safety switches is triggered via the input signals from the first portion of the plurality of inputs when the first safety signal input and the second safety signal are in different states, and the output of the controller is configured to be set when the first safety signal input and the second safety signal are in different states and to be reset when the first safety signal input and the second safety signal are in the same state and the identified safety switch is triggered.

* * * * *

UNITED STATES PATENT AND TRADEMARK OFFICE

CERTIFICATE OF CORRECTION

PATENT NO. : 8,693,159 B2
APPLICATION NO. : 13/069588
DATED : April 8, 2014
INVENTOR(S) : Derek W. Jones, Kevin M. Zomchek and Richard Galera It is certified that error appears in the above-identified patent and that said Letters Patent is hereby corrected as shown below:

In the Claims:

IN CLAIM 1:
(Col. 8, line 50) After "the first safety", insert --signal--
(Col. 8, line 60) Replace "the first safety seal" with "the first safety signal"

IN CLAIM 7:
(Col. 9, line 48) After "receiving", remove ","

IN CLAIM 10:
(Col. 10, line 21) After "comparing", remove ","

Signed and Sealed this
Twenty-second Day of July, 2014

Michelle K. Lee

Michelle K. Lee
*Deputy Director of the United States Patent and Trademark Office*